US010815774B2

(12) United States Patent
Livescu et al.

(10) Patent No.: US 10,815,774 B2
(45) Date of Patent: Oct. 27, 2020

(54) COILED TUBING TELEMETRY SYSTEM AND METHOD FOR PRODUCTION LOGGING AND PROFILING

(71) Applicant: Baker Hughes, a GE company, LLC, Houston, TX (US)

(72) Inventors: Silviu Livescu, Calgary (CA); D. V. Satyanarayana Gupta, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 398 days.

(21) Appl. No.: 15/860,313

(22) Filed: Jan. 2, 2018

(65) Prior Publication Data

US 2019/0203586 A1 Jul. 4, 2019

(51) Int. Cl.

| | |
|---|---|
| ***E21B 47/103*** | (2012.01) |
| ***E21B 19/22*** | (2006.01) |
| ***E21B 47/12*** | (2012.01) |
| ***E21B 47/06*** | (2012.01) |
| ***E21B 47/07*** | (2012.01) |
| ***E21B 47/047*** | (2012.01) |
| ***E21B 47/135*** | (2012.01) |
| *E21B 31/00* | (2006.01) |
| *E21B 37/00* | (2006.01) |
| *E21B 43/11* | (2006.01) |
| *E21B 29/00* | (2006.01) |

(52) U.S. Cl.

CPC ..... *E21B 47/103* (2020.05); *E21B 19/22* (2013.01); *E21B 47/047* (2020.05); *E21B 47/06* (2013.01); *E21B 47/07* (2020.05); *E21B 47/135* (2020.05); *E21B 29/00* (2013.01); *E21B 31/00* (2013.01); *E21B 37/00* (2013.01); *E21B 43/11* (2013.01); *E21B 47/12* (2013.01)

(58) Field of Classification Search

CPC ..... E21B 19/22; E21B 47/10; E21B 47/12
See application file for complete search history.

(56) References Cited

U.S. PATENT DOCUMENTS

| | | | | |
|---|---|---|---|---|
| 6,349,768 | B1 * | 2/2002 | Leising | E21B 23/03 166/255.2 |
| 6,874,361 | B1 | 4/2005 | Meltz et al. | |
| 8,113,284 | B2 | 2/2012 | Jee et al. | |
| 9,631,474 | B2 | 4/2017 | Livescu et al. | |
| 9,631,478 | B2 | 4/2017 | Livescu et al. | |
| 9,850,714 | B2 | 12/2017 | Livescu et al. | |
| 10,132,159 | B2 * | 11/2018 | Burgos | E21B 41/0035 |

(Continued)

FOREIGN PATENT DOCUMENTS

WO 2013/085479 A1 6/2013

OTHER PUBLICATIONS

Livescu et al., "A fully-coupled thermal multiphase wellbore flow model for use in reservoir simulation," Journal of Petroleum Science and Engineering, 2010, pp. 138-146, vol. 71, Elsevier B.V..

*Primary Examiner* — Shane Bomar
(74) *Attorney, Agent, or Firm* — Shawn Hunter

(57) ABSTRACT

Systems and methods for conducting production logging for a wellbore are described which incorporate production logging sensors into a bottom hole assembly which is run in on coiled tubing. The production logging system may include a tool for also conducting a secondary operation, such as milling, fishing, perforation or clean out.

14 Claims, 5 Drawing Sheets

(56) References Cited

U.S. PATENT DOCUMENTS

| | | | | |
|---|---|---|---|---|
| 2005/0263281 | A1* | 12/2005 | Lovell | E21B 34/06 166/255.1 |
| 2007/0044960 | A1* | 3/2007 | Lovell | E21B 49/087 166/250.07 |
| 2012/0080229 | A1* | 4/2012 | Kumar | E21B 49/10 175/50 |
| 2014/0367169 | A1* | 12/2014 | Wheater | E21B 23/14 175/45 |
| 2015/0144331 | A1* | 5/2015 | Livescu | E21B 47/00 166/250.01 |
| 2015/0356403 | A1* | 12/2015 | Storm, Jr. | E21B 49/005 706/12 |
| 2016/0186554 | A1* | 6/2016 | Burgos | E21B 41/0035 166/250.01 |
| 2017/0051600 | A1* | 2/2017 | Jarman | E21B 47/12 |
| 2018/0010419 | A1* | 1/2018 | Livescu | E21B 47/0002 |
| 2018/0087956 | A1* | 3/2018 | Jung | G01V 1/186 |
| 2018/0355682 | A1* | 12/2018 | Pessin | E21B 19/084 |

* cited by examiner

COILED TUBING TELEMETRY SYSTEM AND METHOD FOR PRODUCTION LOGGING AND PROFILING

BACKGROUND OF THE INVENTION

1. Field of the Invention

The invention relates generally to systems and methods for conducting production logging in a wellbore. In particular aspects, the invention relates to systems and methods for production logging using coiled tubing running strings.

2. Description of the Related Art

Production logging is a diagnostic process which evaluates the effectiveness of hydrocarbon production wellbores. Production logging can identify specific problem areas within with wellbore in order to allow operators to correct these problem areas. Production logging is typically performed by a wireline-run sonde which contains flowmeters, acoustic sensing, fluid sampling and/or other sensing devices. Further, production logging generally is not conducted in conjunction with other active operations, such as cleanouts, perforating, fishing, milling, and so forth, but rather is conducted using a separate run of tools.

Prior art techniques for obtaining temperature data within a wellbore have sought to provide such data in "real time." In most cases, a distributed temperature sensing ("DTS") fiber is inserted into coiled tubing which is then run into the wellbore. A DTS fiber is an optic fiber having sensors along its length. The DTS-enabled coiled tubing is left in place within the wellbore for hours, and temperature traces along the entire length of the fiber are acquired and interpreted at surface. Although this method is marketed as being "real time" in the industry, it has two major disadvantages which hinder its effectiveness. First, the fiber is located inside the coiled tubing and does not have direct contact with the wellbore fluids. Thus, its readings depend upon the heat transfer from the annulus through the coiled tubing wall, to the DTS fiber. Second, this is not actually a real time technique, since long periods of time, usually hours, are reported for acquiring time-dependent temperature traces.

In some instances, a DTS fiber is secured to the radial exterior of the completion. In these cases, the DTS fiber installation is permanent. But the arrangement is typically very costly to maintain and prone to failure. Additionally, it cannot be used in an open hole well that has not been completed.

SUMMARY OF THE INVENTION

The present invention provides systems and methods for acquiring data in real time during operations wherein production logging sensing apparatus is located within a production logging sub that is incorporated into a coiled tubing running string. The coiled tubing running string may be a portion of a work string that is used to conduct a secondary operation within a wellbore. The secondary operation can be a cleanout, perforating, fishing or milling operation or other type of operation which is being performed by the work string within the wellbore. During conduct of the secondary operation, production logging is also performed.

In described embodiments, production logging is done by detecting inflow of fluid from the formation into the surrounding wellbore at discrete locations along the length of the wellbore. Inflow detection is done by sensors carried by the production logging sub as the production logging sub is moved along the wellbore. Detection of points of good and poor fluid inflow will allow evaluation of the effectiveness of surrounding portions of the wellbore.

In preferred embodiments, fluid inflow detection is performed by local measurement of temperature at points within the wellbore. Detected temperature at two or more locations or temperature changes over time at the same location are correlated to fluid flow into the wellbore from the formation. That is, the temperature changes in space (i.e., from all sensors at different locations) or in time (i.e., from the same sensors) are input into an energy balance equation solved for fluid flow rates.

In described embodiments, production logging is transmitted to surface during operation to provide real time information concerning the effectiveness of production along the length of a production interval in the wellbore. Preferably, Telecoil technology is used to obtain data from the production logging sub and transmit it to a controller at surface. Tubewire is used to provided power (if needed) to the production logging sub as well as transmits data between the production logging sub and the controller.

In a described embodiment, a production logging sub is incorporated into a production logging system which features a coiled tubing running string. The production logging system also carries a milling bottom hole assembly which is operable to mill away plugs or other obstructions in the wellbore. In operation, the production logging system is disposed into an uncased wellbore or a cased, perforated wellbore which provides a plurality of points for fluid inflow to the wellbore from the surrounding formation. As the production logging system encounters plugs or other obstructions, the milling bottom hole assembly is operated to mill away the plug or obstruction. During the milling operation, the production logging sub detects fluid inflow proximate the location of the plug or obstruction being milled away.

In accordance with the present invention, a production logging sub is incorporated into other coiled tubing operation work strings in order to conduct production logging during a secondary operation by the work string. Exemplary secondary operations performed by the work string include wellbore cleanouts, fishing and perforation.

In particular embodiments, the production logging system includes a work string that is provided with an indexing tool which will provide for selective rotation of the production logging bottom hole assembly with respect to the coiled tubing running string to control tool face position. In described embodiments, the production logging sub presents a radially-directed tool face. Designation of a tool face allows the radial orientation of individual sensors of the production logging sub to be known.

Methods of conducting production logging are described for wellbores into which hydrocarbon production fluid is flowing from a surrounding hydrocarbon-bearing formation. One or more production logging sensors are incorporated into production logging system having a coiled tubing running string and a bottom hole assembly. The production logging assembly is then disposed into the wellbore, and the one or more sensors detect at least one production logging parameter, such as pressure, temperature and/or depth. Data indicative of the at least one production logging parameter is transmitted to a processor which then determines production logging information from the data in real-time.

In accordance with particular described methods, a secondary operation is performed with the bottom hole assembly of the production logging system at the time that the one or more sensors are detecting at least one production logging parameter. The secondary operation may be milling, clean out, perforating or fishing.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
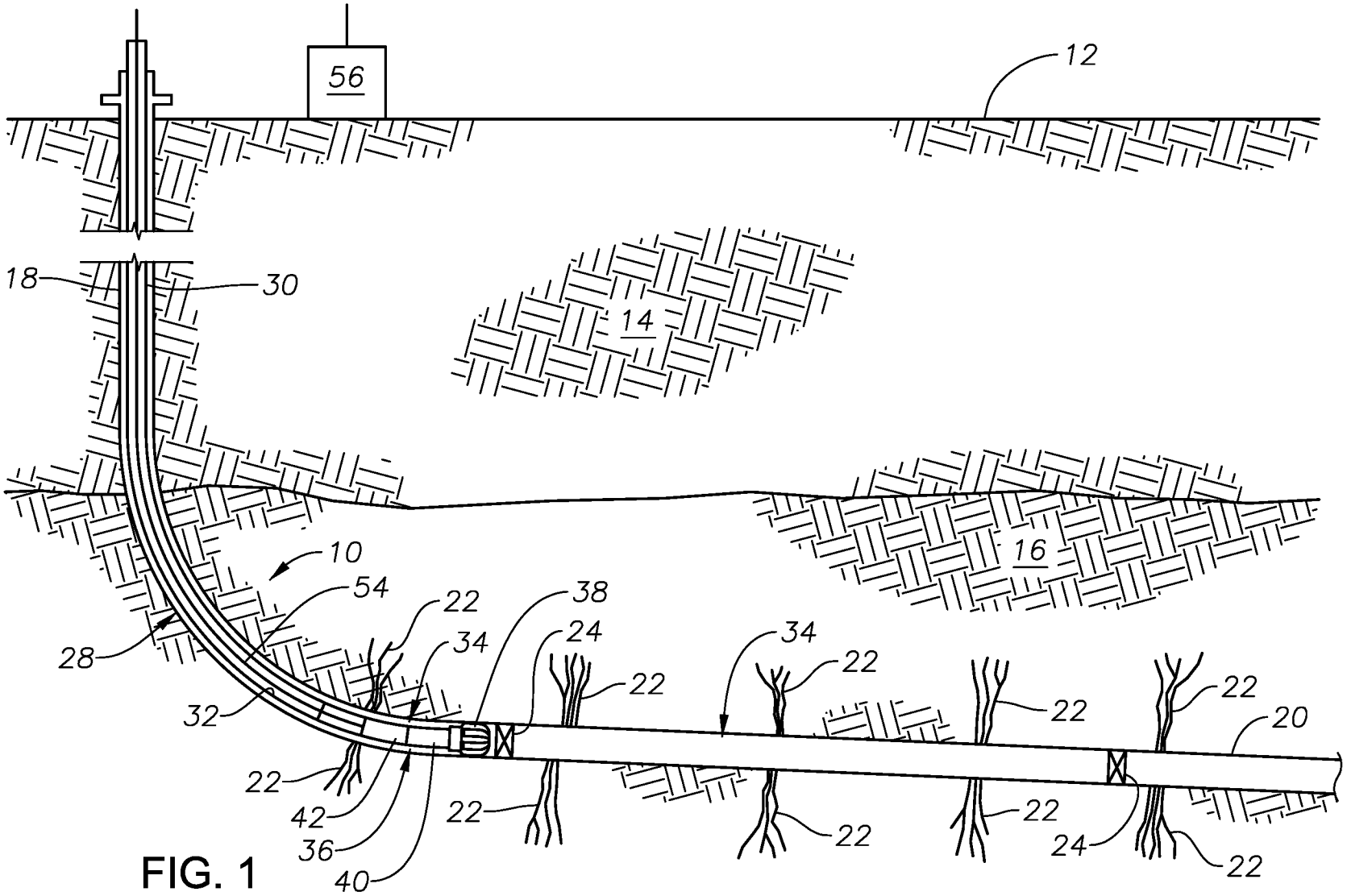
FIG. 1 is a side, cross-sectional view of an exemplary wellbore having a logging and milling work string therein for conducting milling operations and production logging in accordance with the present invention.

FIG. 1 illustrates an exemplary wellbore 10 which has been drilled from the surface 12 down through the earth 14 to a hydrocarbon-bearing formation 16 from which hydrocarbon production fluid is to be produced to surface 12. In the depicted embodiment, the wellbore 10 has a substantially vertical portion 18 and a deviated portion 20 which is substantially horizontal and which passes through the formation 16. A plurality of perforations or fractures 22 extends outwardly from the wellbore 10 into the formation 16. A number of plugs 24 are set within the wellbore 10, having been set during previous wellbore operations. It is desired to remove these plugs 24 from the wellbore 10. In the depicted arrangement, there are two plugs 24. It should be understood, however, that this number of plugs is shown for illustrative purposes only. In practice, there may be more or fewer than two plugs. Additionally, each plug 24 may represent another obstruction within the wellbore 10 which it is desired to remove.

A number of perforations or fractures 26 extend radially outwardly from the wellbore 10 into the formation 16. Hydrocarbon-bearing fluid flows from the formation 16 into the wellbore 10 via the perforations or fractures 26.

A production logging system, generally indicated at 28, extends into the wellbore 10 from the surface 12. The production logging system 28 includes a coiled tubing running string 30. The coiled tubing running string 30 can be injected from surface 12 by a coiled tubing injector of a type known in the art. The coiled tubing running string 30 defines an interior flowbore 32 along its length.

A bottom hole assembly, generally indicated at 34, is affixed to the distal end of the coiled tubing running string 30. The bottom hole assembly 34 includes a milling tool 36. The milling tool 36 features a milling bit 38 which is rotated with respect to tool housing 40 by flow of fluid axially through the milling tool 36.

Figure 2:
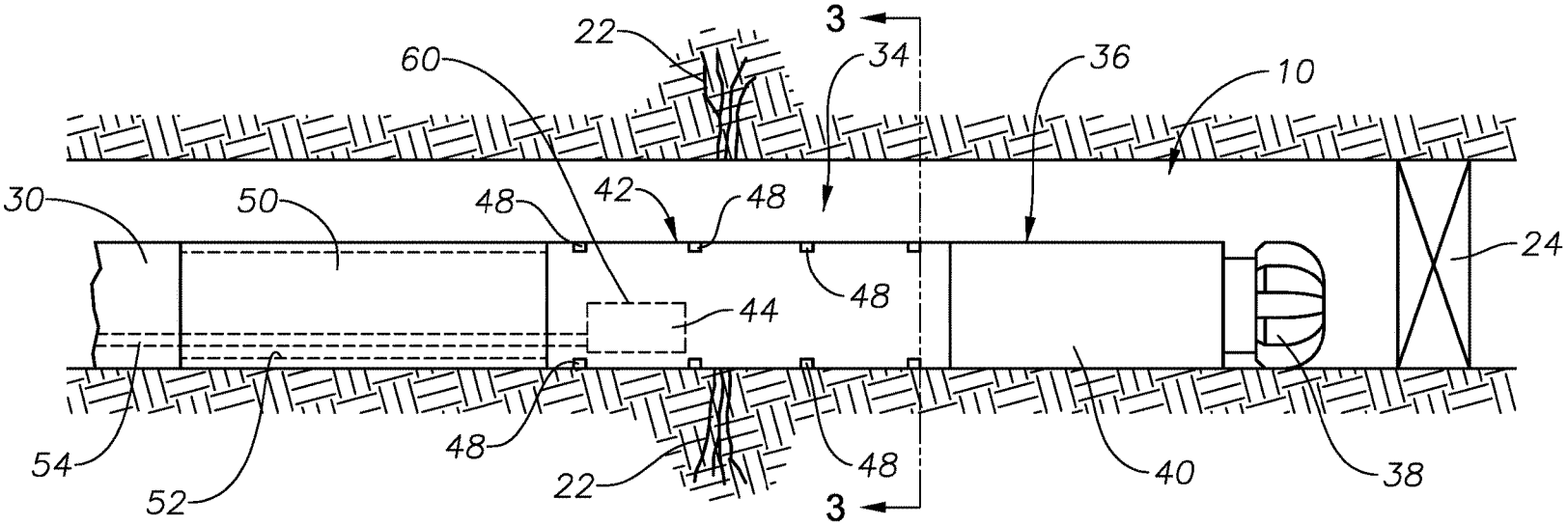
FIG. 2 is an enlarged side, cross-sectional view of an exemplary bottom hole assembly and associated components which incorporates a plurality of sensors in accordance with the present invention.
Figure 3:
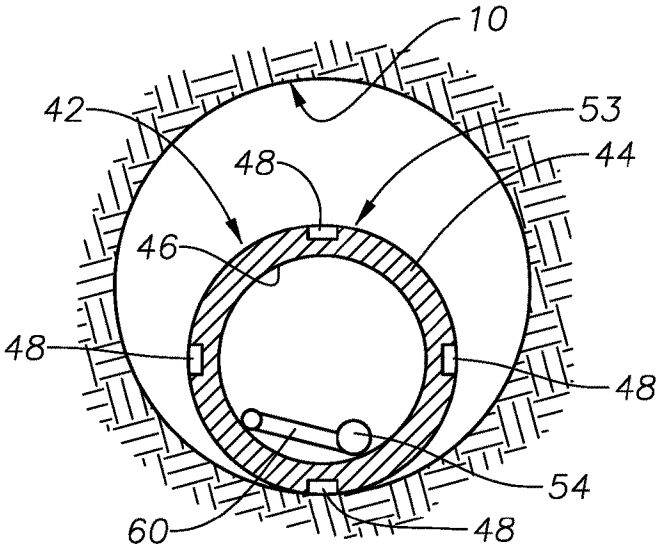
FIG. 3 is an axial cross-section taken along lines 3-3 in FIG. 2.

The bottom hole assembly 34 also includes a production logging sub 42, which is preferably affixed to the milling tool 36. The structure and operation of the production logging sub 42 is better appreciated with further reference to FIGS. 2-3. The production logging sub 42 includes a housing 44 which is generally cylindrical in shape. A flow bore 46 is defined axially along the length of the housing 44. The housing 44 carries at least one, and preferably a plurality of, production logging sensors 48. The production logging sensors 48 may be temperature and/or pressure sensors/transducers or other sensors traditionally used for logging operations. Temperature sensors are operable to detect or measure temperature changes in the annulus fluid surrounding the bottom hole assembly 34 because the temperature sensors are in direct contact with the annular fluid. The production logging sensors 48 may also include one or more sensors which are capable of measuring pressure and/or depth. The production logging sensors 48 are preferably arranged in an array about the outer surface of the housing 44. FIGS. 2-3 illustrate an exemplary array wherein the sensors 48 are spaced apart radially about the circumference of the housing 44. Additionally, the array of sensors 48 includes multiple rows of sensors 48 which are axially spaced along the housing 44, as shown in FIG. 2.

In preferred embodiments, the bottom hole assembly 34 includes an indexing tool 50 which is affixed to the coiled tubing running string 30 and to the production logging sub 42. The indexing tool 50 is operable to rotate the production logging sub 42 with respect to the coiled tubing running string 30. The indexing tool 50 is used to orient the sensors 48 in particular radial directions within the wellbore 10 in order to allow for directional measurement. The indexing tool 50 may be either hydraulically actuated or electrically actuated. The indexing tool 50 defines a central flow passage 52 which allows fluid and cables or conduits to pass through the indexing tool 50. Preferably, the production logging sub 42 presents a radially-directed tool face 53 (FIG. 3). The tool face 53 may be any designated radial portion of the sub 42 and is so designated in order to help orient the sensors 48 of the logging sub 42 angularly within the wellbore 10 and allow an operator to know at any time in which directions (i.e., up/down/left/right, north/south/east/west, etc.) each of the sensors 48 are oriented. This allows an operator to know exactly where temperature or other logging parameters are being measured and fro which direction fluid flow is coming.

A conduit 54 is disposed within the central passage 32 of the coiled tubing running string 30 and passes through central flow passage 52 of the indexing tool 50 to the logging sub 42. In a particularly preferred embodiment, the conduit 54 comprises a conductor known in the industry as tubewire, which can be disposed within the coiled tubing to provide a Telecoil conductive system for data/power. The term "tubewire", as used herein, refers to a tube which may or may not encapsulate a conductor or other communication means, such as, for example, the tubewire manufactured by Canada Tech Corporation of Calgary, Canada. In the alternative, the tubewire may encapsulate one or more fiber optic cables which are used to conduct signals generated by sensors 34 that are in the form of fiber optic sensors. The tubewire may consist of multiple tubes and may be concentric or may be coated on the outside with plastic or rubber. In alternative embodiments, the conduit 54 may be a fiber optic cable.

Figure 4:
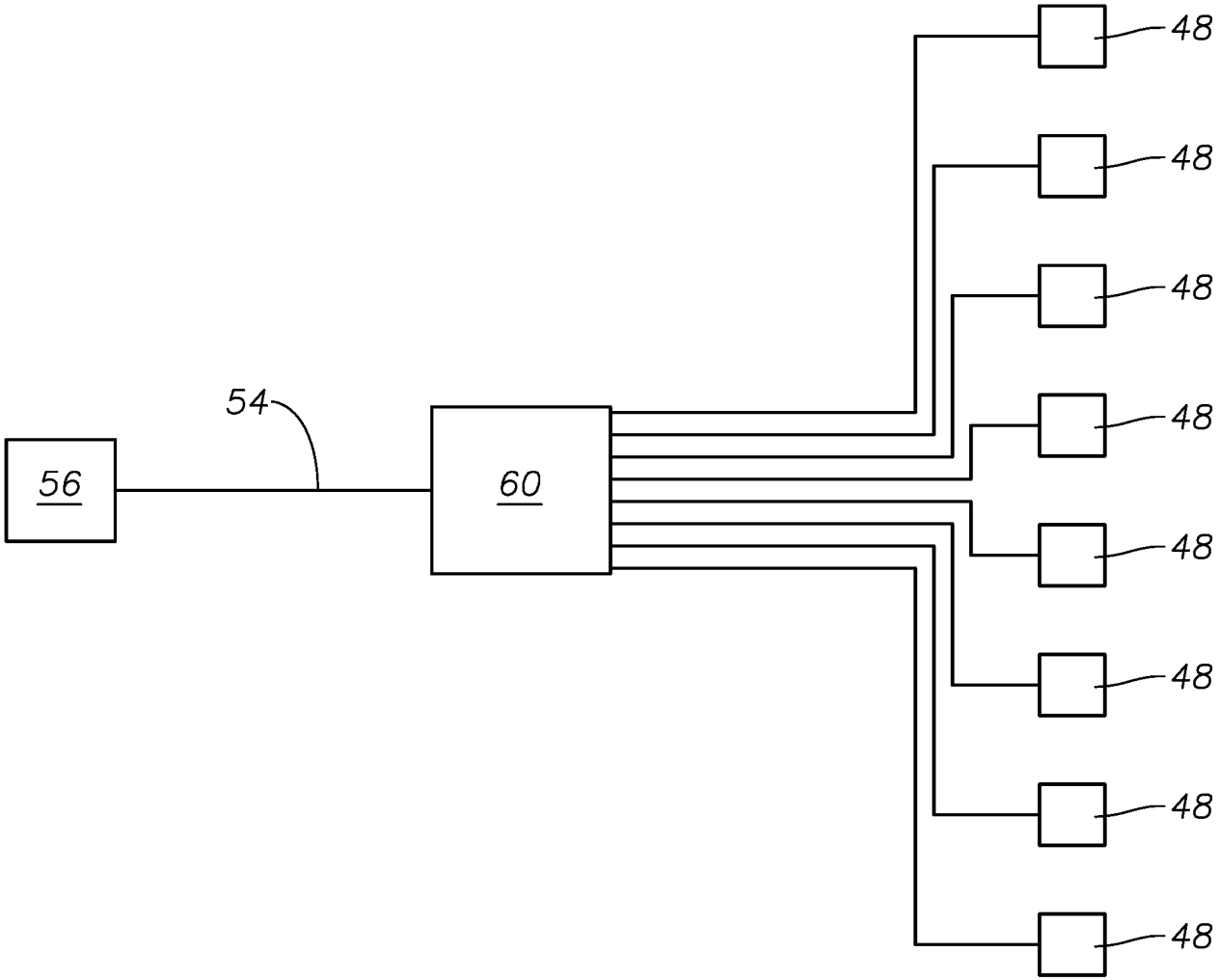
FIG. 4 is a schematic diagram illustrating exemplary electrical and communication connections for a production logging arrangement in accordance with the present invention.

The conduit 54 extends to surface-based signal processing equipment 56 at the surface 12. FIG. 4 illustrates exemplary surface-based equipment to which the conduit 54 might be routed. The conduit 54 is operably interconnected with a signal processor 58 of known type that can analyze and in some cases, record and/or display representations of the sensed temperature and/or pressure parameters. Suitable signal processing software, of a type known in the art can be used to process, record and/or display signals received from the sensors 48. In the instance where the conduit 54 encases optic fibers rather than electrical conductors, the signal processor 58 includes a fiber optic signal processor. A typical fiber optic signal processor would include an optical time-domain reflectometer (OTDR) which is capable of transmitting optical pulses into the fibers and analyzing the light that is returned, reflected or scattered therein. Changes in an index of refraction in the optic fiber can define scatter or reflection points. The signal processing equipment 56 can include signal processing software for generating a signal or data representative of the measured conditions.

In certain embodiments, a memory module is operably associated with the logging sub 42 to store detected data. FIG. 4 depicts a memory module 60 which is operably associated with the sensors 48 to receive and store detected production logging data. The stored data can be retrieved once the bottom hole assembly 34 is removed from the wellbore 10.

Figure 5:
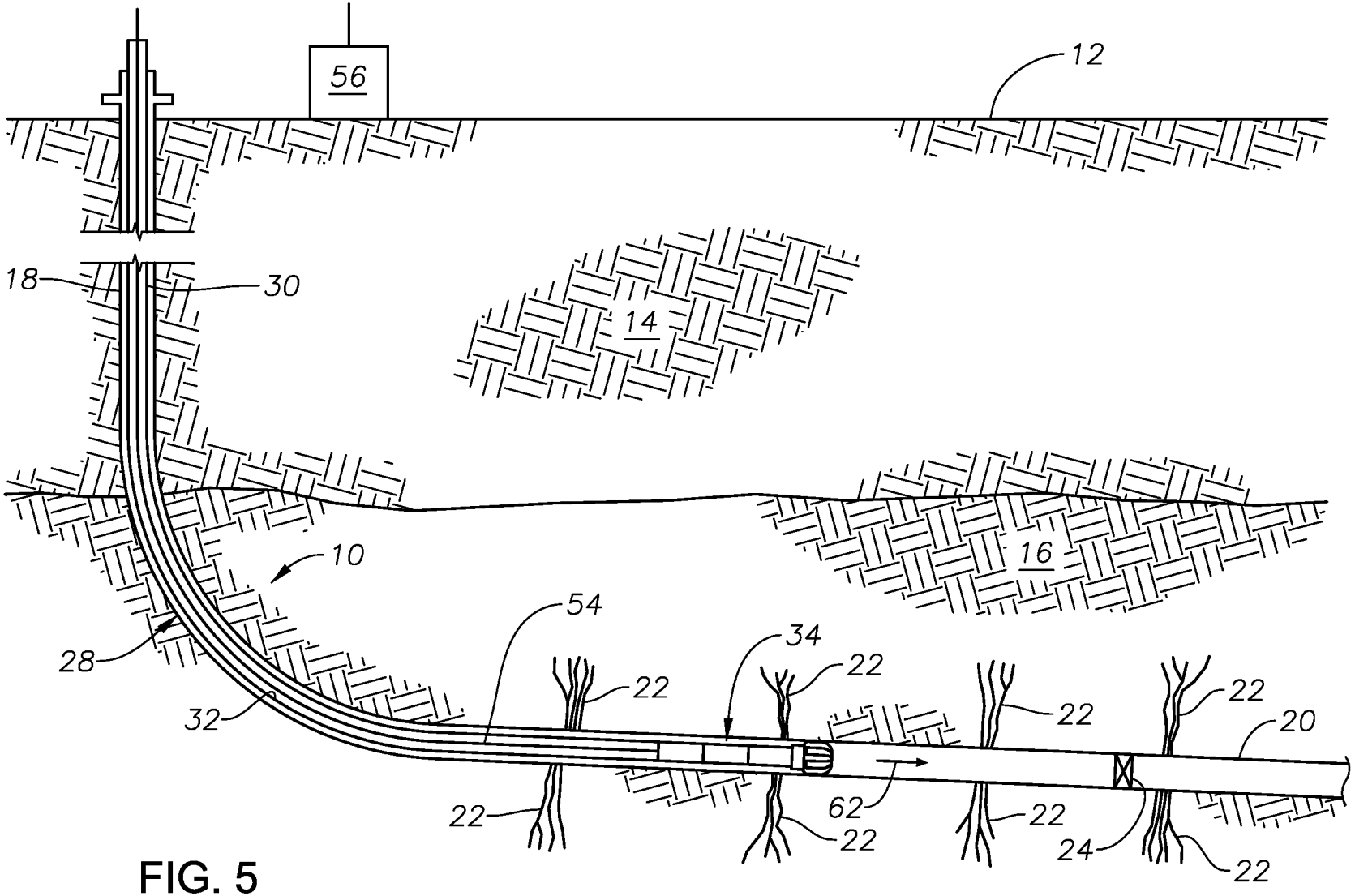
FIG. 5 is a side, cross-sectional view of the wellbore and logging and milling work string of FIG. 1, now with the bottom hole assembly at a deeper position within the wellbore.
Figure 6:
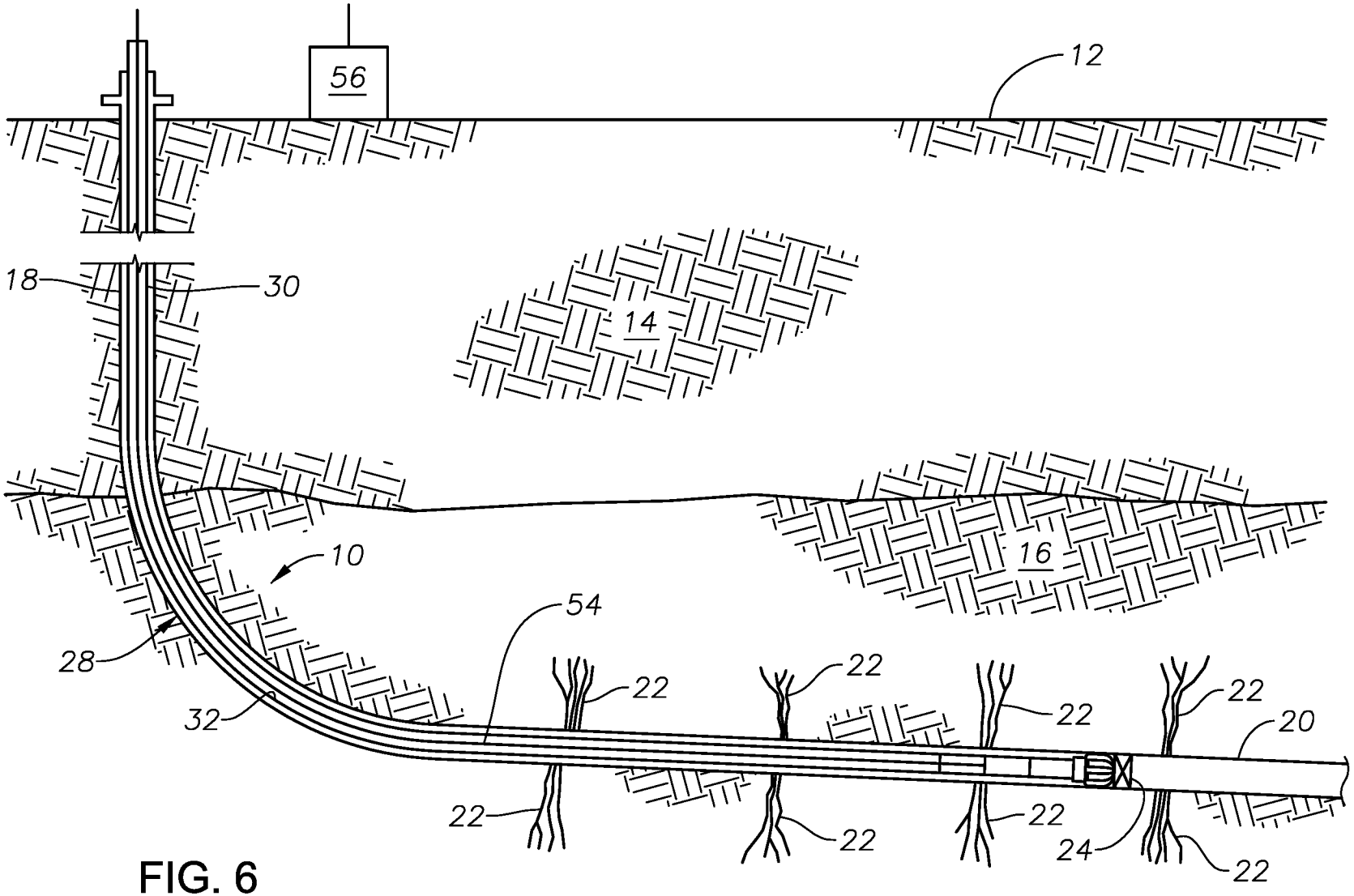
FIG. 6 is a side, cross-sectional view of the wellbore and logging and milling work string of FIGS. 1 and 5, now with the bottom hole assembly at a deeper position within the wellbore.

In operation, the production logging system 28 is moved through the wellbore 10 to mill away the plugs 24. Milling of the plugs 24 is the secondary operation being conducted by the tool 28. As the milling is done, the production logging sub 28 detects temperature data which is indicative of fluid flow into the wellbore 10 through the perforations 22. FIGS. 1, 5 and 6 illustrate the production logging system 28 at different stages of a milling and logging operations. In FIG. 1, the milling tool 36 is encountering the uppermost plug 24 in the wellbore 10. Fluid flow from the surface 12 through the flowbore 32 of the coiled tubing running string 30, the indexing tool 50 and the logging sub 42 will drive the milling tool 36 to mill away the plug 24. During this time, logging sub 42 detects flow data relating to fluid flow from the uppermost perforations 22. In FIG. 5, the production logging system 28 has milled through the uppermost plug 24 and is being moved in the direction of arrow 62 toward the second, lowermost plug 24. During movement through the wellbore 10, the production logging sub 42 detects flow data relating to fluid flow into the wellbore 10 from the perforations 22 which are located between the upper and lower plugs 24. FIG. 6 depicts the production logging system 28 at a further point in the milling and logging operation wherein the milling tool 36 encounters the lowermost plug 24 and is operated to mill the plug 24 away. During milling, the production logging sub 42 detects additional flow data relating to fluid flow from proximate perforations 22.

In conjunction with the processing equipment 56, the sensors 48 are operable to detect temperature change within the wellbore 10 proximate the perforations 22. In other embodiments, the sensors 48 detect pressure and/or depth within the wellbore 10. The methods of operation are primarily designed for use in open-hole wells, but might also be used with cased holes. Downhole temperature modeling for coiled tubing operations using such conservation equations is described in Livescu et al., SPE Paper 168299, "Analytical Downhole Temperature Model for Coiled Tubing Operations," (2014) which is hereby incorporated by reference in its entirety. Mathematical modeling is preferably performed by the processing equipment 56 to determine fluid flow rates into the wellbore 10 at or near each of the perforations 22. Those of skill in the art will understand that the systems and methods of the present invention allow for real-time temperature and pressure data acquisition and real time flow rate data interpretation.

As the production logging system 28 is pulled out of the wellbore 10, temperature, pressure and/or depth data is acquired along the wellbore 10 as well. Using this data as input in the mathematical model, the flow rate into the wellbore 10 from formation 16 is calculated at particular points along the wellbore 10 by the processing equipment 56. The calculated flow rates can be used by an operator to evaluate production performance and decide in real time how the production could be optimized or improved. Knowing the time and location for the data collected, the differences between the measured temperatures at different times are used to calculate flow rates.

Using the data that was sensed during run in and the data sensed as the production logging system 28 is withdrawn, fluid flow rates are calculated at surface. The calculated flow rates are considered to be real time flow rates of production fluid into the wellbore 10 from the formation 16. If necessary, corrections can be made to portions of the wellbore 10 to improve flow from underperforming portions. An operator can optimize the fluid flow rate and schedule based upon the determined fluid flow rate. For example, if the calculated flow rates at particular location indicates that there has not been sufficient injection of fracturing fluid or proppant 130, additional injection of fracturing fluid or proppant may be performed.

It will be understood that the milling tool 36 could be replaced by a tool or set of tools which perform another secondary task or operation within the wellbore 10. Exemplary secondary operations include fishing, clean out and perforation.

What is claimed is:

1. A production logging system for use within a wellbore, the production logging system comprising:

a coiled tubing running string;

a bottom hole assembly affixed to the coiled tubing running string, the bottom hole assembly having a production logging sub having a housing with at least one production logging sensor which is operable to detect temperature change data indicative of fluid flow into the wellbore;

a conduit which provides electrical power from a surface location to the at least one production logging sensor; and a signal processor operably interconnected with the at least one production logging sensor and configured to determine production fluid inflow information from the detected temperature change data.

2. The production logging system of claim 1 wherein the bottom hole assembly further comprises at least one secondary work device incorporated within the bottom hole assembly.

3. The production logging system of claim 2 wherein the secondary work device comprises a milling, cleanout, perforating or fishing tool.

4. The production logging system of claim 1 wherein the at least one production logging sensor further comprises a sensor for detection of pressure or depth.

5. The production logging system of claim 1 wherein the signal processor is operably interconnected with the at least one production logging sensor by tubewire which contains the conduit which provides electrical power to the at least one production logging sensor.

6. The production logging system of claim 1 wherein the signal processor determines production fluid inflow information in real time as a secondary work device incorporated within the bottom hole assembly performs a secondary operation.

7. The production logging system of claim 1 wherein the at least one production logging sensor further comprises:

an array of sensors which includes multiple rows of sensors which are axially spaced along the housing to detect inflow of fluid from the formation into the wellbore at a discrete location within the wellbore.

8. The production logging system of claim 7 wherein sensors of the array of sensors are spaced apart radially about a circumference of the housing.

9. A method for conducting production logging for a wellbore into which hydrocarbon production fluid is flowing from perforations in a surrounding hydrocarbon-bearing formation, the method comprising:

incorporating at least one production logging sensor into a production logging system having a coiled tubing running string and a bottom hole assembly;

disposing the production logging system into the wellbore;

providing electrical power from a surface location to the at least one production logging sensor;

detecting at least one production logging parameter with the at least one production logging sensor as hydrocarbon production fluid is flowing into the wellbore from the perforations in the formation;

transmitting data indicative of the detected at least one production logging parameter to a processor;

determining production logging information from the data in real-time with the processor.

10. The method of claim 9 further comprising the step of:

performing a secondary operation with the bottom hole assembly at the time that at least one production logging parameter is detected by the at least one production sensor.

11. The method of claim 10 wherein the secondary operation comprises at least one of: milling, clean out, perforating or fishing.

12. The method of claim 9 wherein the at least one production logging parameter comprises temperature, pressure or depth.

13. The method of claim 9 wherein the step of transmitting data indicative of the detected at least one production logging parameter to a processor further comprises transmitting the data along a tubewire which is located within a flowbore of the coiled tubing running string.

14. The method of claim 9 further comprising the step of:

rotating the production logging sub with respect to the coiled tubing running string within the wellbore in order to orient the tool face to provide directional measurement within the wellbore.

* * * * *